United States Patent [19]

Fischer et al.

[11] Patent Number: 4,785,930

[45] Date of Patent: Nov. 22, 1988

[54] AMMUNITION CONTAINER

[75] Inventors: Marco Fischer, Hochwald; Hans Kaspar, Aesch; Heinrich Wohlgemuth, Arlesheim, all of Switzerland

[73] Assignee: Muller AG Verpackungen, Munchenstein, Switzerland

[21] Appl. No.: 89,547

[22] Filed: Aug. 26, 1987

[30] Foreign Application Priority Data

Sep. 17, 1986 [CH] Switzerland ..... 3720/86

[51] Int. Cl.[4] ..... F42B 37/00; F42B 39/00; B65D 85/62

[52] U.S. Cl. ..... 206/3; 206/511

[58] Field of Search ..... 206/3, 511

[56] References Cited

U.S. PATENT DOCUMENTS

| | | | |
|---|---|---|---|
| 2,127,263 | 8/1938 | Lambert | 206/3 |
| 2,292,702 | 8/1942 | Lambert | 206/3 |
| 2,346,700 | 4/1944 | Parsons et al. | 206/3 |
| 2,903,124 | 6/1958 | Carver | 206/3 |
| 3,160,062 | 12/1964 | Moy et al. | 206/3 X |
| 3,446,394 | 5/1969 | Miller et al. | 206/511 |
| 4,566,588 | 1/1986 | Kataczynski | 206/3 |
| 4,733,773 | 3/1988 | La Bianca et al. | 206/3 |

FOREIGN PATENT DOCUMENTS

| | | | |
|---|---|---|---|
| 327725 | 10/1920 | Fed. Rep. of Germany | 206/3 |
| 298525 | 11/1920 | Fed. Rep. of Germany | 206/3 |
| 334235 | 3/1921 | Fed. Rep. of Germany | 206/3 |
| 3002284 | 1/1980 | Fed. Rep. of Germany . | |
| 1003614 | 11/1951 | France . | |
| 2092992 | 2/1982 | United Kingdom . | |

*Primary Examiner*—William Price

*Attorney, Agent, or Firm*—Morris Fidelman; Franklin D. Wolffe

[57] ABSTRACT

An ammunition container having a container tube and a lid at the front end is used for the storage and transport of grenades (10), rockets or the like. The intention is to rationalize transfer and facilitate operation (stackable, loading and unloading in the horizontal position). For this purpose, two parallel stacking surfaces (3, 4) located opposite one another are provided in the region of the two tube ends, and the lid is in the form of a hinged lid (6), the joint of which (axle 7) is located within the distance between the stacking surfaces and preferably parallel to the stacking surfaces. A pair of stacking surfaces is expediently provided on a collar, which is penetrated by the container tube (2). A double container having two adjacent tubes in common collars is advantageous. Two variants of lid closures, a transport lock, and a simple, cheap pressure equilibration valve are described.

11 Claims, 2 Drawing Sheets

AMMUNITION CONTAINER

Figure 1:
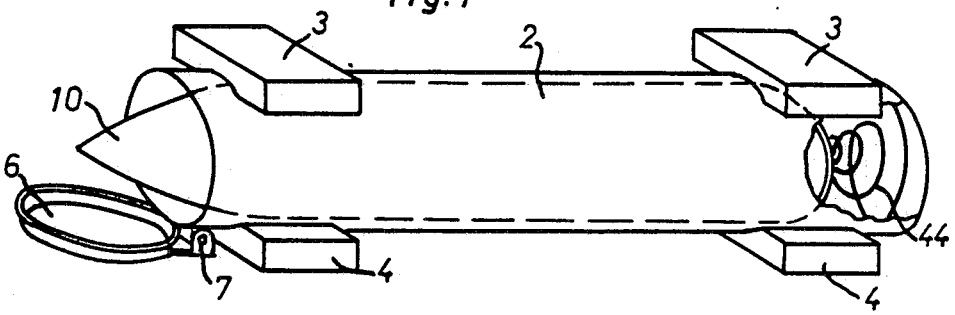

The invention relates to an ammunition container having a container tube and a lid located at the front end. Known ammunition containers of this type, as used for the storage and transport of grenades, rocket projectiles or the like, have a loose lid which is detachably fastened to the open front end of the container tube by means of a clamping ring. Ammunition containers of this design cannot be stacked; baskets or boxes with considerable additional weight and corresponding "dead" volume are required for transport. Furthermore, these known ammunition containers can be opened and closed only in the upright position, making the introduction and in particular the removal of the ammunition considerably more difficult. Moreover, when the containers are handled in the vertical position, there is a danger that they may tip over, which may cause damage.

The object of the invention is to provide an improved ammunition container which permits more efficient ammunition transfer and makes handling of the ammunition easier and safer.

In order to achieve these objects, the ammunition container according to the invention is characterized in that two parallel stacking surfaces located opposite one another are provided in the region of the two tube ends and that the lid is in the form of a hinged lid and is hinged within the distance between two stacking surfaces located opposite one another. This permits horizontal stacking of the containers and in particular palletizing without additional containers being necessary. This means that the storage area is optimally utilized and ballast is dispensed with during transport. Another, important advantage is that the hinged lid can also easily be operated in the stack, with the result that the containers can conveniently be loaded and unloaded in the horizontal position.

In a particularly expedient embodiment, the stacking surfaces are arranged in pairs on two collars which are penetrated by the container tube and are firmly connected thereto. Two adjacent container tubes can advantageously be combined to form a double container if their ends each penetrate a common collar. Other advantageous embodiments of the ammunition container according to the invention are present.

Various embodiments of the subject of the invention are illustrated in more detail below in conjunction with the drawing.

Figure 2:
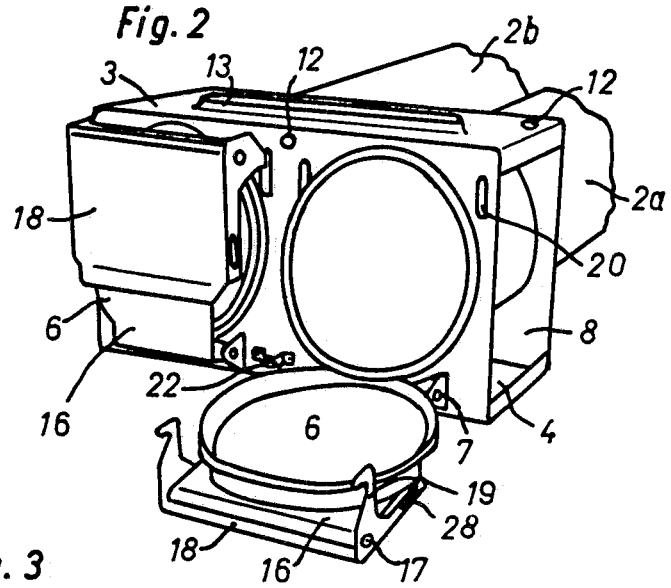
Figure 3:
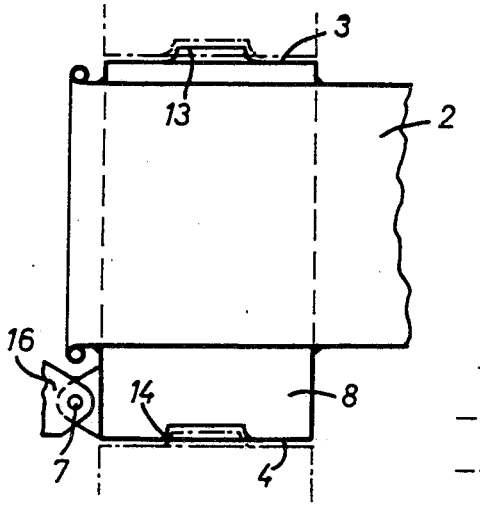
Figure 4:
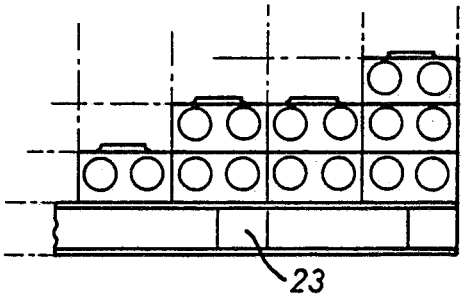
Figure 5:
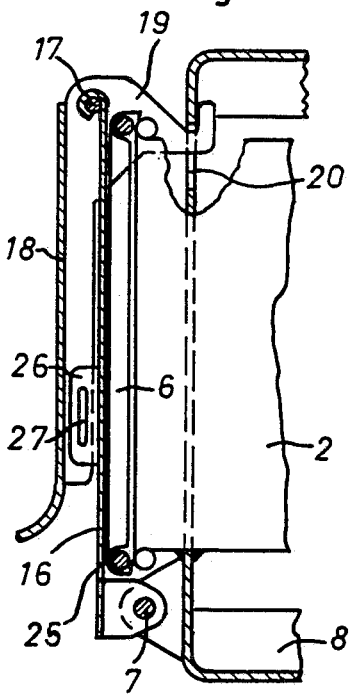
Figure 6:
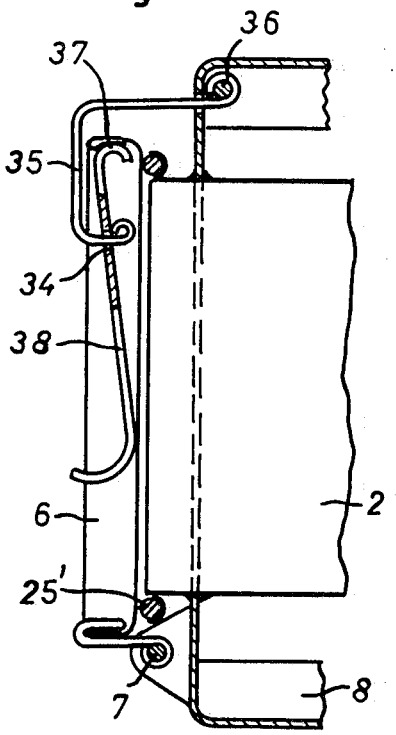
Figure 7:
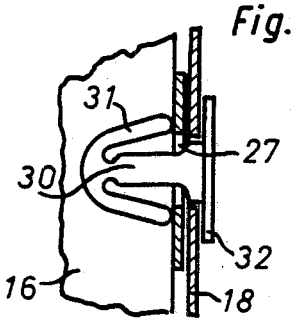

FIG. 1 shows a simplified perspective representation of a first embodiment,

FIG. 2 shows, likewise as a perspective view, the lidbearing end of a double container, one of the lids being closed and the other open, FIG. 3 is a vertical section through the lid-bearing end of a container tube and the associated collar (lid omitted), the collars of the adjacent ammunition containers in the stack being indicated, FIG. 4 shows a schematic front view of a plurality of double containers stacked on a pallet, FIG. 5 and FIG. 6 illustrate two differet variants of a lid closure, in each case as a vertical section, FIG. 7 shows a particular embodiment of a plug-type lid lock as a detail in a section parallel to the plane of the lid, and FIG. 8 shows, once again as a vertical section a particularly simple and advantageous embodiment of a pressure equilibration valve inserted in the lid.

The ammunition container according to FIG. 1 is in the form of a single container for a grenade 10. The container tube 2 is terminated at one end (right-hand side in FIG. 1) by a base and can be closed at the other end by a hinged lid 6 located at the front end. Two parallel stacking surfaces 3 and 4 located opposite one another are provided on the container tube 2, in the region of the two tube ends; in the present case, these stacking surfaces are each formed by a plate firmly connected to the tube. The swivel axle 7 of the lid 6, which axle is preferably parallel to the stacking surfaces 3 and 4, is likewise mounted on the container tube 2 and is located within the distance between the stated stacking surfaces opposite one another. Because of this joint, the hinged lid 6 can easily be operated at any time, particularly in the horizontal position shown and when several containers are stacked one on top of the other by means of their stacking surfaces.

As shown in FIG. 1, an ejection spring 44 (conical spring) can advantageously be arranged on the bottom of the container tube 2 so that, when the hinged lid is opened, the grenade 10 projects partially from the tube 2 and can easily be gripped.

The embodiment according to FIG. 2 is a double container having two adjacent container tubes 2*a* and 2*b*. Here, the upper stacking surface 3 and the parallel lower stacking surface 4 are provided on a collar 8 which is penetrated by the front ends of the container tubes 2*a* and 2*b* and is firmly connected to these. A second such collar having a corresponding pair of stacking surfaces is located in the region of the rear, closed tube ends and is not visible in FIG. 2. The collar 8 is preferably provided with anchor points for attaching a carrying belt (not shown), for example in the form of holes 12 and/or brackets 22.

The orderly and safe stacking of a plurality of ammunition containers one on top of the other is facilitated by locking means which are provided on the stacking surfaces 3 and 4 and are realised here in the form of flanged edges 13 and 14 (FIG. 3) along an elongated opening in the stacking surfaces. As shown in FIG. 3, the flanged edge 13 on each stacking surface 3 points away from the container tube 2 while the corresponding edge 14 on the opposite stacking surface 4 points towards the tube 2. This permits mutual interlocking of the adjacent, stacked ammunition containers, as indicated by dash-dot lines in FIG. 3. Of course, such locking means can also be realised in other ways, for example by cams and appropriate holes, etc.

A stack formed from a plurality of double containers and arranged on a pallet 23 is shown schematically in FIG. 4.

Of course, the above embodiments as well as the further embodiments apply not only to a double container but also to single containers.

The design of the hinged lid 6 shown in FIG. 2 and having an associated hook closure is also shown in vertical section in FIG. 5. The lid 6, on the inner edge of which a ring seal 25 is placed, is firmly connected to an anchor plate 16. This is mounted by means of plates on the swivel axle 7, which in turn is anchored to the front of the collar 8. At the edge located opposite the swivel axle 7, the anchor plate 16 holds an axle 17 which serves for the pivotable mounting of an operating flap 18. The flap 18 has two angled hooks 19 which pass through corresponding slot-like openings 20 in the collar 8 when the lid is closed. When the operating flap 18 is lifted about the axle 17, the hooks 19 are unlocked and the lid 6 together with the flap can be swivelled out (right-hand side in FIG. 2).

In contrast to the hook closure according to FIG. 5, FIG. 6 shows a variant of the lid closure in the from of a snap-on closure. A ring seal 25' is held here on the opening edge of the container tube 2, and the lid 6 is provided with a projecting edge. An operating flap 38 which overlaps the lid similarly to FIG. 5 is supported on the inside of the lid edge at 37 but is not connected to the lid. A locking bracket 35 is hinged with the flap 38 at 34 and with the collar 8 at 36. If the lower end of the flap 38 is lifted from the lid 6, a dead center position is passed and the bracket 35 bends elastically upwards. The flap 38 then lifts off the lid at the point 37, and the lid can be swivelled around the axle 7.

In order to lock the operating flap in the closed position or to indicate unauthorized opening of the lid, a lock is provided which is described with reference to FIG. 7 in conjunction with FIG. 2 and 5 (a corresponding lock would also be possible in the variant according to FIG. 6). A lateral web of the operating flap 18 has a slot-like opening 28 (FIG. 2), and an angled plate 26 on the anchor plate 16 connected to the lid is provided with a corresponding slot 27 which is aligned with the slot 28 when the flap is in the closed position. Such overlapping openings can be used for applying a conventional lead seal or, advantageously according to FIG. 7, for holding a locking plug 30, which is expediently produced in one piece from plastic. Two spreading arms project laterally from one end of a central web of the locking plug 30, and a gripping plate 32, which may serve for designating the container contents, is located at the other, outer end. Insertion of the plug 30 through both openings 27 and 28 is effected with elastic bending of the spreading arms 31, which subsequently spring back into the position shown in FIG. 7 and thus grip behind the plate 26. The operating flap 18 and the hinged lid 6 can then be opened again only if the locking plug 30 is pulled out forcibly, causing it to break.

Figure 8:
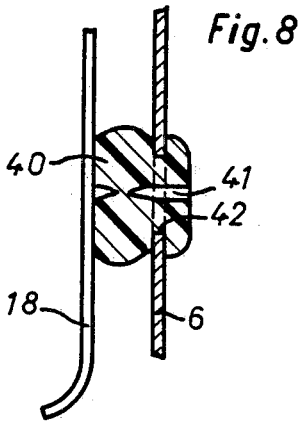

Owing to pressure differences, which are unavoidable during transport and prolonged storage of the ammunition containers, the hinged lid which tightly closes the container tube may be difficult to open. To overcome this difficulty, relatively complicated and expensive pressure equilibration valves were previously required on the container. In contrast, FIG. 8 illustrates a very simple and expedient valve arrangement in conjunction with the operating flap overlapping the hinged lid. A soft rubber stopper 40, which has a pressure equilibration hole 41, is inserted in an opening 42 of the lid surface. As long as the lid 6 is closed and flap 18 assumes the closed position, the stopper 40 is compressed by the flap and the hole 41 is thus kept closed. However, when the operating flap is lifted, the hole immediately opens and equilibrates the pressure inside the container.

We claim:

1. A stackable ammunition container which comprises:

an ammunition container tube wherein an elongated round of ammunition may be disposed, the tube being closed at a rear end thereof and being provided with a hinged lid at a front end thereof; and stacking means mounted on said tube, said stacking means comprising one pair of parallel stacking surfaces opposing one another positioned on the side of said tube adjacent the front end thereof and a like pair of parallel stacking surfaces positioned on the side of said tube adjacent the rear end thereof, whereby a multiplicity of ammunition tubes resting on their sides may be stacked in stacking surface to stacking surface contact;

the hinge of said hinged lid being within the space encompassed by said stacking means, allowing the hinged lid to be opened for removal of ammunition from any tube in a stacked array of ammunition container tubes.

2. An ammunition container according to claim 1 wherein the front end stacking surfaces further comprise a collar through which the ammunition container tube extends, said hinged lid being on and forming part of said collar.

3. An ammunition container according to claim 2 further comprising a collar encompassing two ammunition container tubes, thereby providing a double ammunition container tube unit.

4. An ammunition container according to claim 1 wherein said hinge is parallel to said stacking surfaces.

5. An ammunition container according to claim 1 further comprising an ejection spring inside said tube at the rear end thereof, whereby opening of said lid causes the ammunition round to project out from said tube.

6. An ammunition storage unit which comprises:

an ammunition container tube wherein an elongated round of ammunition may be disposed, the tube being closed at a rear end thereof, open at a front end thereof;

stacking means mounted on said tube said stacking means comprising a front end collar around the front end of said tube whereon are a pair of parallel stacking surfaces opposing one another positioned on the side of said tube adjacent the front end thereof and a rear collar around the rear end portion of said tube whereon are a like pair of parallel stacking surfaces positioned on the side of said tube adjacent to rear end thereof whereby a multiplicity of ammunition tubes resting on their sides may be stacked in stacking surface to stacking surface contact;

a hinged lid on the front end collar closing off the open front end of said tube, the hinge thereof extending parallel to said stacking surfaces and within the space encompassed by said stacking surfaces, allowing said hinged lid to open for removal of ammunition from any tube in a stacked array of ammunition tubes; and on the same collar as said lid, closure means for maintaining said lid in closed position.

7. An ammunition storage unit as in claim 6 wherein said closure means includes an operating flap which overlaps said lid.

8. An ammunition storage unit as in claim 7 wherein lateral openings are provided in said lid and in said operating flap for insertion of lid locking means therein.

9. An ammunition storage unit as in claim 7 wherein a pressure equilibration valve is present in said lid, and wherein said operating flap overlaps the valve to maintain the valve closed until said operating flap is moved for purposes of opening said lid.

10. An ammunition storage unit as in claim 6 wherein said closure means comprises a hook closure.

11. An ammuniction storage unit as in claim 6 wherein said closure means comprises a snap-on closure.

* * * * *